US005132729A

United States Patent [19]

Matsushita et al.

[11] Patent Number: 5,132,729

[45] Date of Patent: Jul. 21, 1992

[54] GENUINE SECURITY ARTICLE DISTINGUISHING SYSTEM FOR AN IMAGE FORMING APPARATUS

[75] Inventors: Tetsuo Matsushita; Shoji Imaizumi, both of Shinshiro; Hiromitsu Saijo, Toyokawa, all of Japan

[73] Assignee: Minolta Camera Kabushiki Kaisha, Osaka, Japan

[21] Appl. No.: 646,696

[22] Filed: Jan. 25, 1991

[30] Foreign Application Priority Data

Jan. 25, 1990 [JP] Japan ..... 2-17573

[51] Int. Cl.[5] ..... G03G 21/00

[52] U.S. Cl. ..... 355/203; 355/204; 380/23

[58] Field of Search ..... 355/203, 204, 206; 380/23, 25

[56] References Cited

U.S. PATENT DOCUMENTS 4,670,857 6/1987 Rackman ..... 380/23 X 4,873,549 10/1989 Tada et al. ..... 355/206

FOREIGN PATENT DOCUMENTS 261643 9/1987 European Pat. Off. .

62-83768 4/1987 Japan .

*Primary Examiner*—R. L. Moses

*Assistant Examiner*—P. Stanzione

*Attorney, Agent, or Firm*—Price, Gess & Ubell

[57] ABSTRACT

An image forming apparatus having replaceable or exhaustible component parts is provided with a security system to determine the authenticity and remaining service life of the component parts. The component part can be provided with an identifiable code, for example, stored in a RAM that can be checked with predetermined identification codes in a computer system in the image forming apparatus. Verification of the authenticity of the replaceable component part can govern the operation of the copying apparatus. The component part, for example, can be provided with a manufacturer code and a confidential identity code. This manufacturer code can be compared with the stored manufacturer code, and a determination can be made as to whether the product is authentic and the remaining useful life of the product. If the product is not authentic, the copying apparatus can be disabled. Also, if the product has been rebuilt or has come to the end of its useful life, the copying apparatus can be disabled.

21 Claims, 6 Drawing Sheets

GENUINE SECURITY ARTICLE DISTINGUISHING SYSTEM FOR AN IMAGE FORMING APPARATUS

BACKGROUND OF THE INVENTION

1. Field of the Invention

The present invention relates to an apparatus for distinguishing whether a replaceable article loaded on to it is a genuine product or not and to an image forming apparatus such as a copying machine and a laser beam printer, and particularly to an image forming apparatus having stored therein a confidential identity number which is obtained from the manufacturer's code on the consumptive component part.

2. Description of Related Art

In a conventional copying machine which is an image forming apparatus, there is a continued need to replace various components such as replenishing of toner, cleaning of developer unit, cleaning of corona charger and replacement and adjusting of other consumptive materials. Such replacements must be carried out periodically and professional workers should usually conduct them. Since such professional workers specially in charge of these works are required, the service cost for these works affects to increase the price of the apparatus.

In the case of small size apparatus being intended for an individual or a small scale business, the price must be inexpensive. It is especially important to decrease the service cost for such apparatus consequently. Accordingly, each of such plural component parts are integrated into one unit and can be set in and removed from the main body.

Such consumptive component parts are usually manufactured as genuine parts by the manufacturer of the copying machine and sold to the users. However, these consumptive parts are often manufactured and sold to the users by third parties without permission from the manufacturer. For instance toner for use in a copying machine is already widely manufactured by the third parties.

If the user uses such consumptive parts manufactured by the third party and it causes troubles to the copyig machine, the warrant of the manufacturer cannot be relied upon to the disadvantages of the user. In the case, for instance, where an imitation of an image forming unit having integrated various units in the periphery of the photosensitive members as one unit is used, the characteristics of the photosensitive member frequently differs from the genuine product to cause unevenness in an image density, resulting in inferior image quality and voiding a warranty In the other case where the useful life of a component part comes to its end and it is remanufactured or rebuilt, the performance is not only unstable but also its life is short. Likewise, the performance is not warranted and may bring about disadvantages to the user.

SUMMARY OF THE INVENTION

The present invention has been made in view of such a situation as noted above. The first object of this invention is to provide an image forming apparatus that can prevent the use of an imitation product instead of the genuine product and therefore can warrant the quality of the consumptive or replaceable component parts by giving a manufacturer's code to the consumptive parts, collating the result of a predetermined security processing with the predetermined confidential identity number and by controlling the image forming operation according to the collating result.

The second object of the present invention is to provide an image forming apparatus that can prevent an imitation product from being used by giving the manufacturer's code and a confidential identity number which is obtained by a predetermined processing to the consumptive component part, and, when the consumptive component part is set in the main body of the apparatus, reading out the manufacturer's code to process a predetermined operation, collating the processing result with the stored confidential identity number and by controlling the image forming operation corresponding to the collating result. The third object of the present invention is, besides the above-mentioned objects, to provide an image forming apparatus that can prevent regenerated articles and imitation parts from being used by prohibiting the use of the consumptive component part that has come to the end of its useful life.

The fourth object of the present invention is to provide an apparatus that can distinguish a genuine replaceable article by collating the processing result of a definite operation treatment to the first identifying information stored in the replaceable article with predetermined second identifying information.

The above and further objects and features of the invention will more fully be apparent from the following detailed description with accompanying drawings.

BRIEF DESCRIPTION OF THE DRAWINGS

FIGS. 4(*a*) and 4(*b*) are respectively flow charts showing the controlling procedures of copying when the power source is turned on.

DESCRIPTION OF THE PREFERRED EMBODIMENTS

Hereinbelow an embodiment of the present invention is described in detail with references to the drawings.

Figure 1:
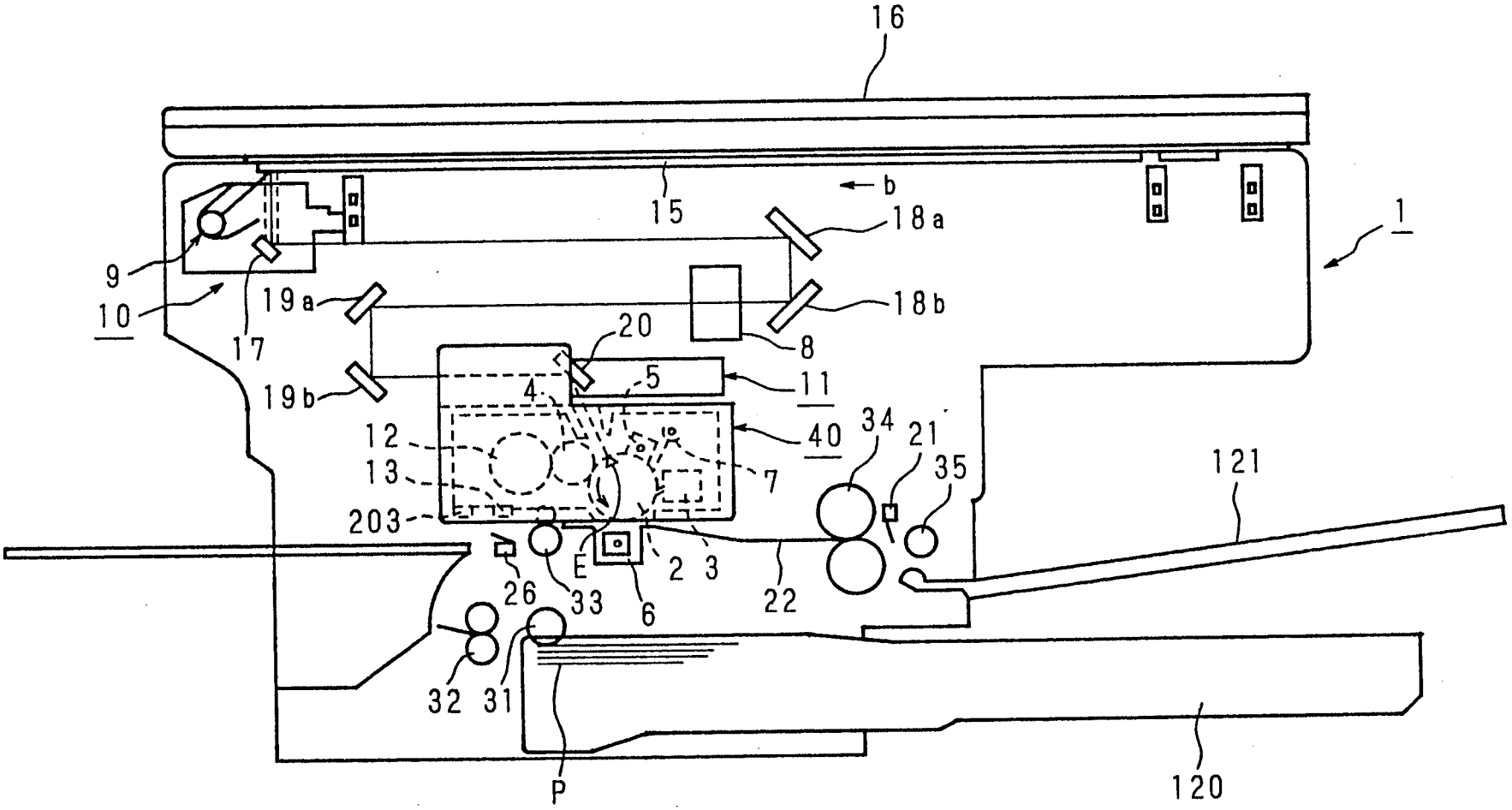
FIG. 1 is a schematic longitudinal sectional view showing the internal structure of a copying machine being an image forming apparatus according to the present invention.

In FIG. 1, numeral 1 is the main body of the copying machine. On its upper surface, a document table 15 made of a glass plate is installed. A document placed on the table is scanned by an optical scanning unit 10 driven by a scanning motor (not shown). The image is formed on the photosensitive drum 2 as on electrostatic latent image.

The optical scanning unit 10 includes an exposure lamp 9, movable mirrors 17, 18*a*, 18*b*, lens 8, fixed mirrors 19*a*, 19*b*, 20 and the like.

The optical scanning unit 10 is consisting of light reflecting or transmitting from the document exposes the photosensitive drum 2 at the defined exposure location E. A first slider or carriage equipped with the exposure lamp 9 and the movable mirror 17 and a second slider equipped with the movable mirrors 18*a*, 18*b* move in the direction of arrow mark b. At this time, the first slider moves twice as fast as the first slider, to scan the document. FIG. 1 shows the positions of the first and second sliders when they are performing a maximum scanning.

A cover 16 is pivotally supported on the document table 15 at the back side of the copying machine, and an up-and-down movement of a front side end part closes-and-opens the document table 15. Cover 16 opens permits positioning of the document of a single leaf or in a book form placed on the table with the picture image facing downward and then closes the table for copying it.

Figure 2:
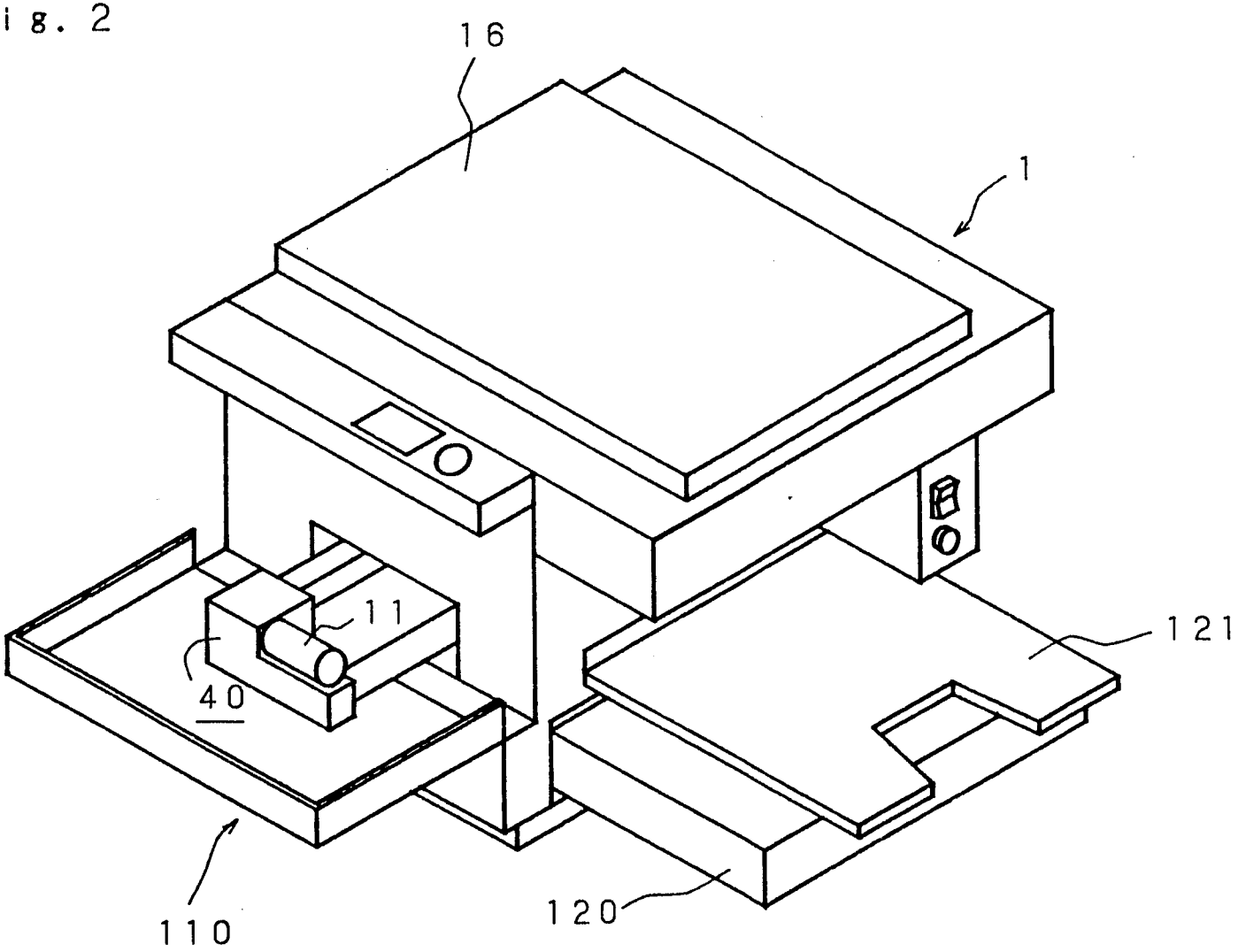
FIG. 2 is a schematic of perspective view of the copying machine showing set and removed states of the image forming unit.

As shown in FIG. 2, on the front side of the main body 1, a front cover 110 is pivotally supported at its lower side so that it can be opened. By turning its upper front part, the main body 1 can open and close itself for permitting the inspection and removal of an image forming unit 40 which is a consumptive component part, that is, it is exhausted after a predetermined number of copying cycles.

The photosensitive drum 2 has an optical conductive layer on its outer peripheral surface, and can rotate in a counter-clockwise direction indicated by an arrow mark. Over the photosensitive drum 2, an corona charger 5 is disposed to bestow charge of a certain level of electric potential to the surface of the photosensitive drum 2.

The peripheral speed V of the photosensitive drum 2 is constant, and the moving speed of the first slider and the second slider of the optical scanning unit 10 are V and V/2 respectively.

At a down stream side from the exposure position E of the photosensitive drum 2, a development unit 4 is arranged. The development unit 4 turns the static electric latent image formed on the surface of the photosensitive drum 2 into positive toner image by application of timer with a magnetic brush. At a location under the photosensitive drum 2, a transfer charger 6 is arranged. This transfer charger bestows electric field to the copying paper from its back side as it is delivered from the cassette 120 which will be described later, and the developer unit 4 transfers the toner image formed on the surface of the photosensitive drum 2 onto the copying paper P.

In the direction of rotation of the photosensitive drum 2 of the transfer charger 6, a cleaning unit 3 is provided. The cleaning unit 3 removes the residual toner on the surface of the photosensitive drum 2 by means of a blade assembly. At a location between the cleaning unit 3 and a corona charger 5, an eraser lamp 7 is provided. The eraser lamp 7 removes electric charge on the surface of the photosensitive drum 2 by reason of irradiation of light in order to prepare for the following copying process.

Photosensitive drum 2, eraser lamp 7, developer unit 4, cleaning unit 6, corona charger 5 are integrated into one unit as a process unit 40. The process unit 40 can be set in a removable manner in the main unit 1. At the opposite side of the photosensitive drum 2 of the developer unit 4 the process unit 40 includes a transport conveyor 12 for transporting developer. The transport conveyor 12 uses a blade (not illustrated) to churn the developer solution with their rotations and to supply it to the developer unit 4 by the magnetic brush. At an upper part of the process unit 40, a developer supply unit 11 is provided. The developer supply unit 11 supplies a definite volume of developer to the transport conveyor 12. In the image forming assembly 40, RAM 203 is provided for storing a memory of 6 digits as a recognition number, which is the first identifying information (manufacturer's code), and second identifying information, obtained by processing the above recognition number, to be described later that is, total of 8 digits of manufacturer's code having an aligned 2 digits of confidential identity numbers and information such as data relative to the number of dischargings of copying paper. Under the transport conveyor 12, a toner density sensor 13 is provided to detect the density of toner. The density of toner indicates the composing ratio of toner and carrier. The ratio is detected by detecting carrier which is a magnetic substance by means of the toner density sensor 13 using a magnetic sensor.

At an approximate center part of the main body 1, a control unit 100 is installed employing a microcomputer which performs various controls of the copying machine.

In FIG. 1, numeral 120 is a cassette for containing copying papers P. It can be freely set in and removed away from the main body 1, and is provided with a paper sending roller 31. The paper sending roller 31 is connected with a motor (not shown) equipped in the interior and is rotatably driven by it. The copying paper P is sent out from the cassette 120 to the timing roller 33 by way of an intermediate roller 32, and, after taking adjusting timing, it is further sent to the space between the photosensitive drum 2 and the transfer charger 6.

Here, the copying paper P having been transcribed with a toner image is sent to the fixing unit 34 by way of the transport route 22. The fixing unit 32 fuses and fixes the toner image on the copying paper P with heat. The copying paper P is sent out to the copy tray 121 after the image has been fixed.

Figure 3:
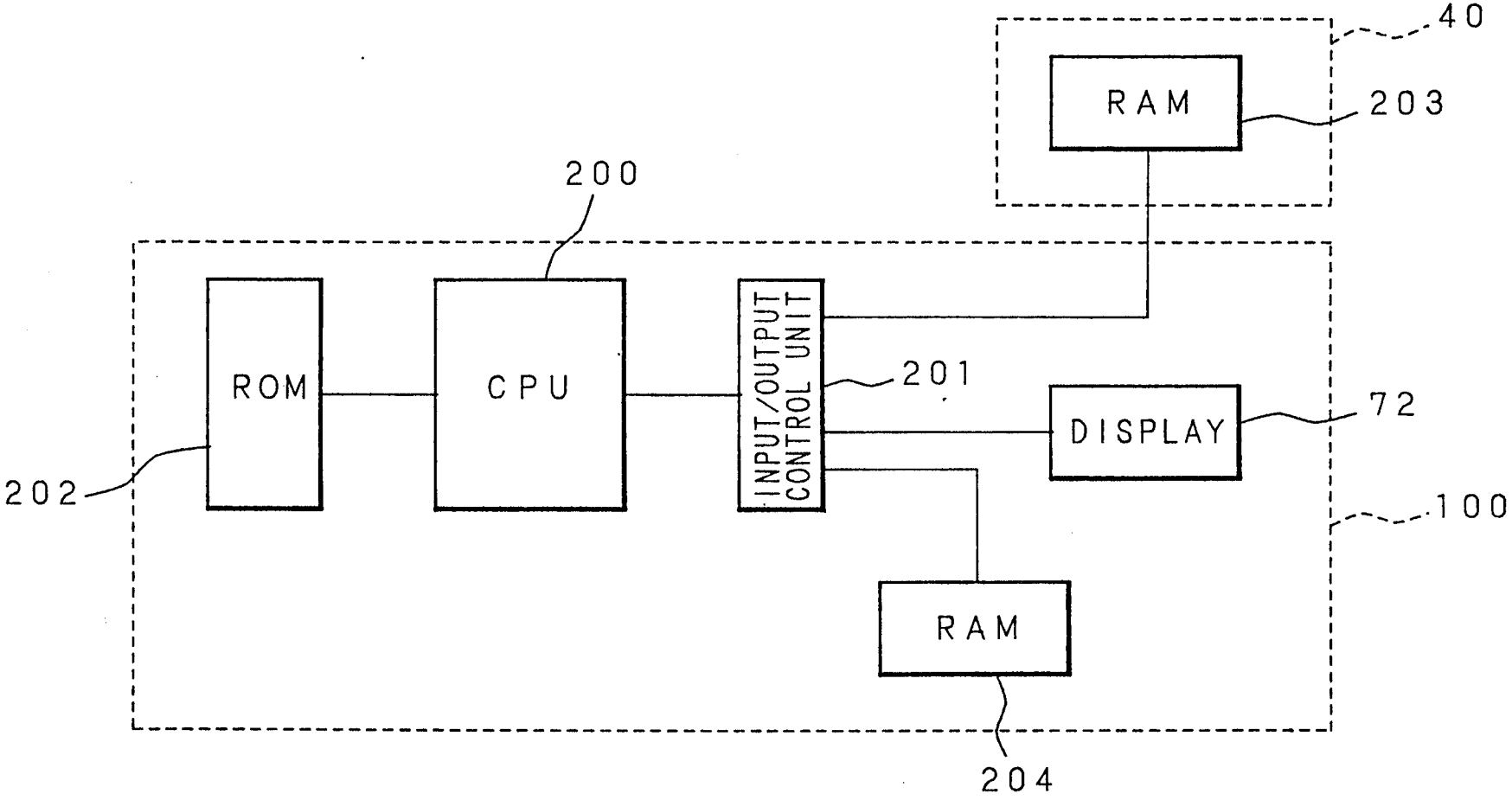
FIG. 3 is a block diagram showing an essential configuration of the control unit 100.

FIG. 3 is a block diagram showing the essential configuration of the control unit 100. The microcomputer (hereinafter referred to as CPU) 200 is connected with ROM 202 storing a memory of the control program of the main body 1, and the life or machine usage data which indicates the normal life cycle data of the copying machine. Further RAM 203 installed in the process unit 40, indicator unit 72 using LED or the like and RAM 204 storing the 6 digits of recognition number (hereinafter referred to as the unit number) of the image forming unit 40 are connected to the CPU 200 via an input and output control unit 201.

Figure 4A:
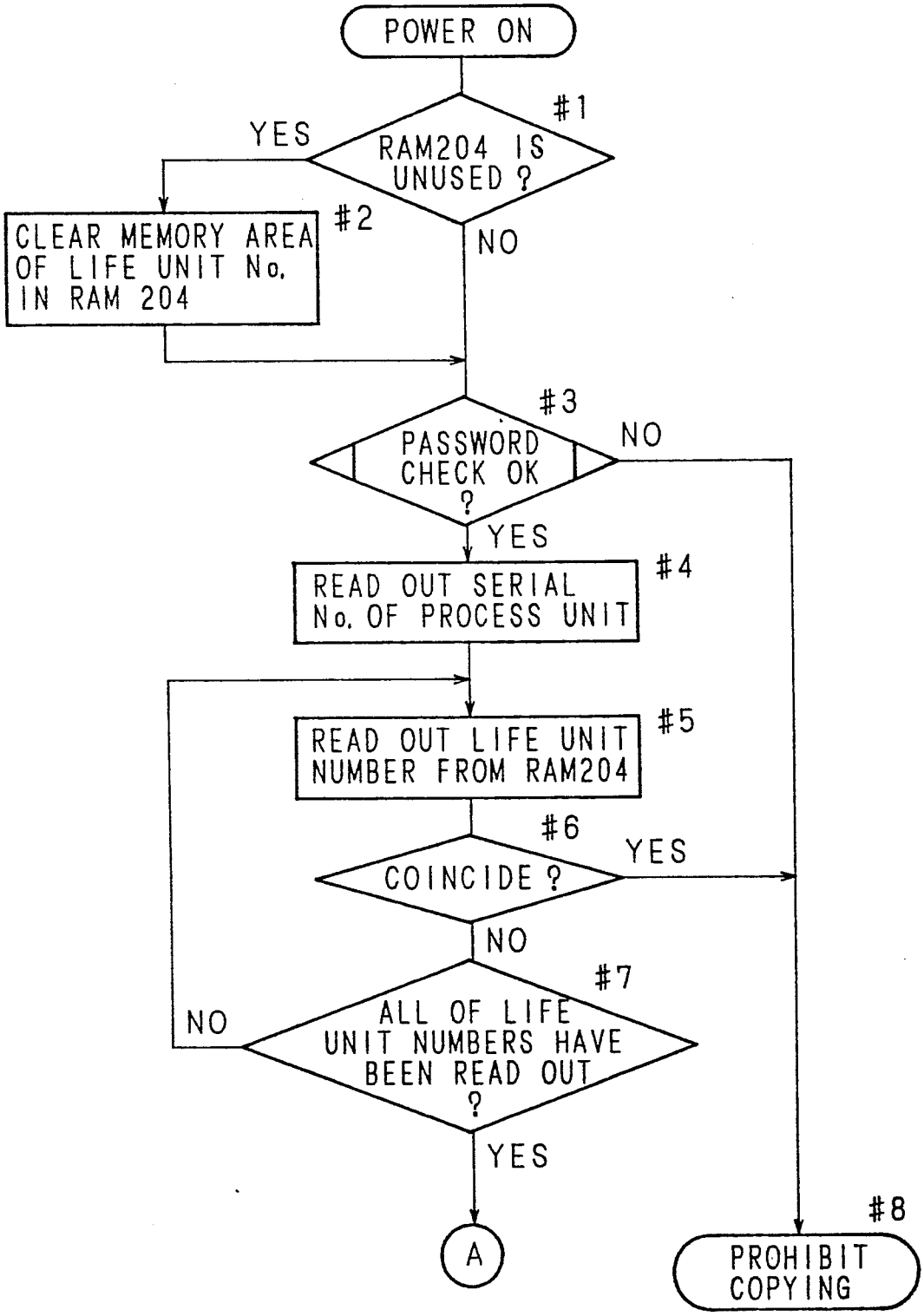
Figure 4B:
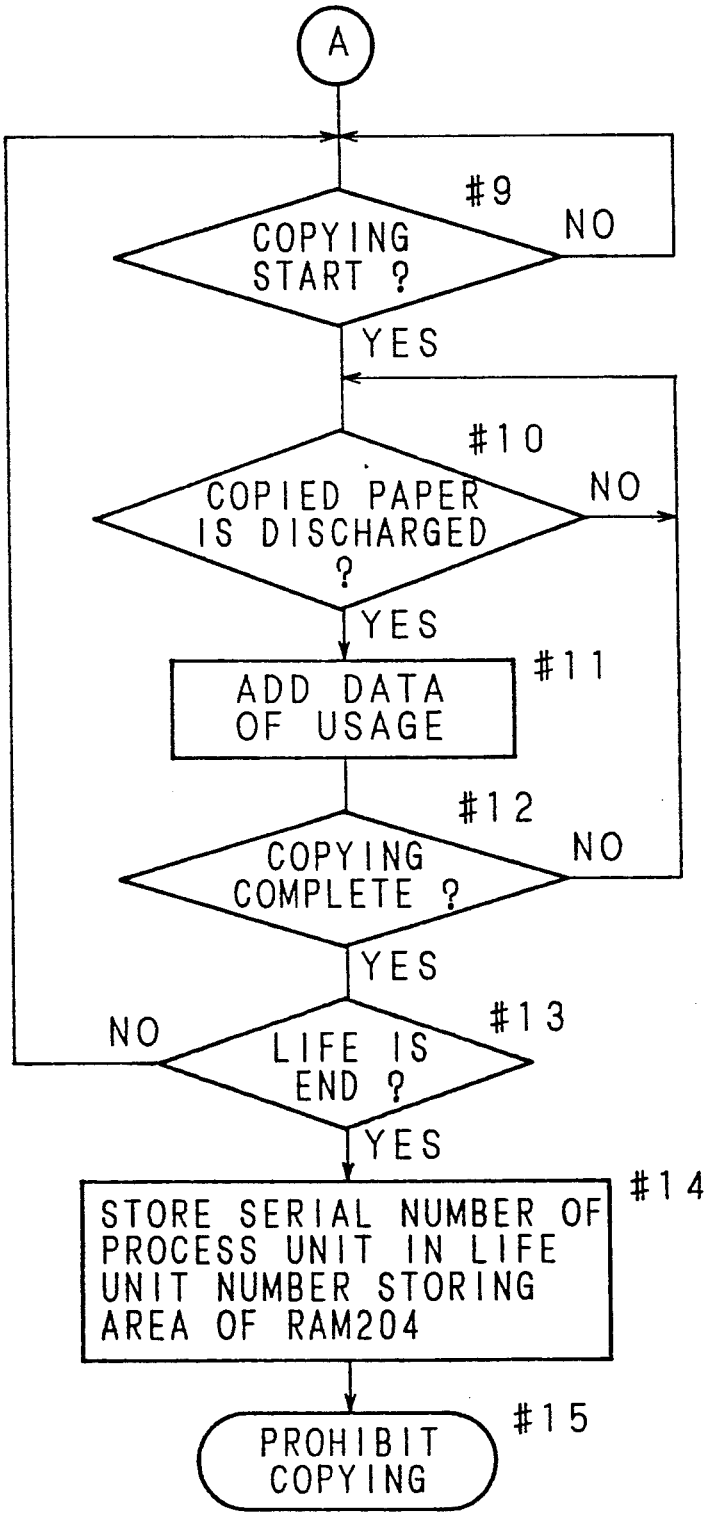
Figure 5:
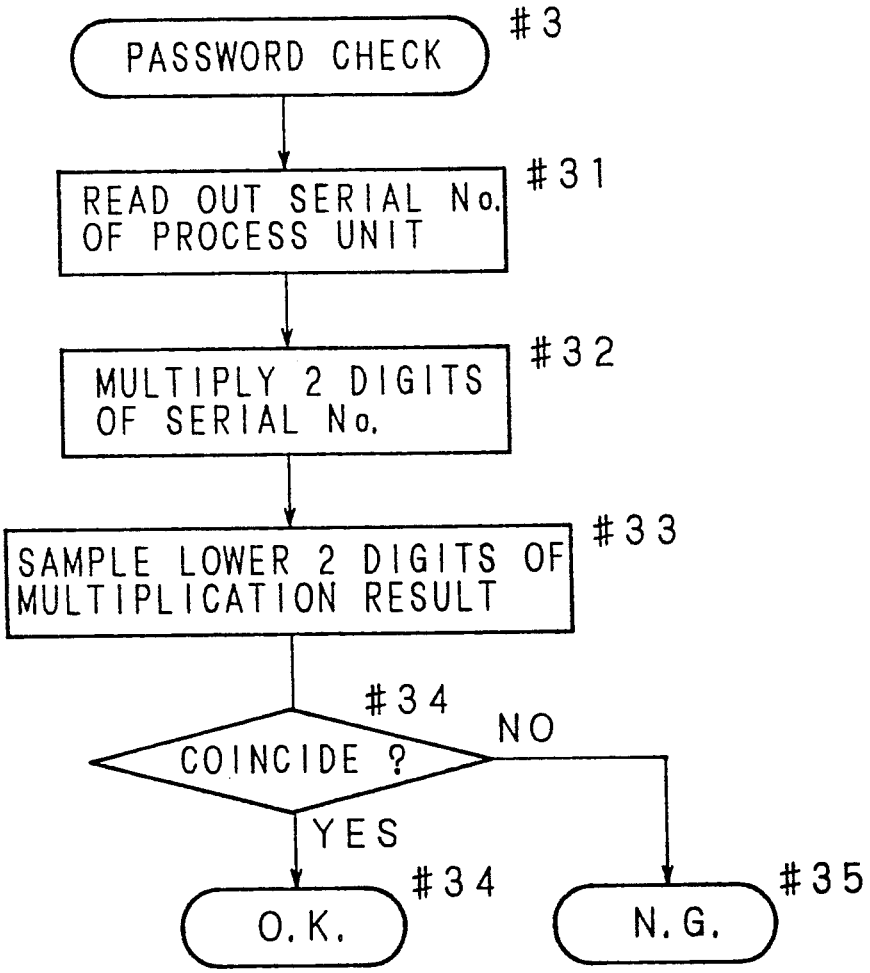
FIG. 5 is a flow chart showing a processing procedure of the confidential identity number check subroutine.

Next, description is made of the control procedures by CPU 200 with references to the flow charts shown in FIGS. 4 and 5. FIG. 4(*a*) and 4(*b*) are flow charts showing the controlling procedures of copying when the power source is turned on. When the power source is turned on, it is judged whether the RAM 204 of the main body 1 is used or not used (step #1). In the case where the RAM 204 is not used, CPU 200 clears the memory area of any life unit number inside of the RAM 204 (step #2) and the processing proceeds to a checking subroutine to check the confidential identity number of the image forming unit 40 (step #3) described in detail in FIG. 5. In the case where it is already used, the processing proceeds to step #3. FIG. 5 is a flow chart showing the processing procedure of checking a subroutine of the confidential identity number in step #3. Here, a check is done as to whether data of the confidential identity number stored in RAM 203 in the process unit 40 is valid or not. Reading out the 8 digit manufacturer's code of the process unit 40 first (step #31), and extracting 2 digits by 2 digit from the upper end of the code to make a multiplication of them (step #32). An 8 digit manufacturer's code is, at the time of production, made of a 6 digit recognition number (for instance, "123456") and the last 2 digit of the result (="70") obtained by multiplication of each 2 digits from the uppermost down to the last (12H×34H×56H=13A70H) combined to get (12345670).

The program proceeds to extract the last 2 digits in the result of multiplication (step #33), and determines whether it coincides with the last 2 digit manufacturer's identity number or not. If the two coincide; e.s., the confidential identity number is valid, it is judged that the process unit 40 is genuine, that is, check is the verification O.K. (step #34). If the two do not coincide; e.g., the confidential identity number is invalid, it is judged that the unit is not genuine, that is, the check result is N.G. (step #35). On the basis of the result of the this judgment, (step #35) the step #3 in FIG. 4 certifies that the image forming unit 40 is decided to be an imitation product, thereby prohibiting the operation of the copying in step #8.

In the case where the process unit 40 is judged as a genuine product, the production number of the process unit 40 is read out again (step #4) and the upper 6 digits of the recognition number thereof is extracted. And the life unit number kept in the memory of RAM 204 in the main body is read out (step #5). Then, the extracted recognition number and the life unit number are compared with each other to judge whether or not the two coincide (step #6). If the two coincide, it is judged that the process unit 40 having come to the end of its life is being used again, and the processing proceeds to step #8 to stop the copying operation. If they do not coincide, it is judged that whether or not all the life unit numbers stored in RAM 204 have been read out (step #7). Then it is judged that whether or not all life unit numbers coincide with the recognition numbers (step #8). In the case where the life unit numbers fail to coincide to the last one, and it is judged that the process unit 40 that is set in is not the one having come to the end of its life and regenerated, but it is a new genuine product, this decision enables the copying operation (step #9). When the copying operation starts, CPU 200 waits until the copied paper comes to the copy tray 121 (step #10). Confirming that the copied paper is discharged, addition is made to the used quantity data stored in RAM 203 in the image forming unit 40 (step #11) to renew the data of use quantity. That is to say, the used quantity data of the image forming unit 40 is stored as the counted value obtained by counting the times of a copying operation. Upon confirming the end of a series of a copying operation (step #12), it is judged that whether or not the life of the process unit 40 has come to the end of its useful life (step #13). This is done by comparing the used quantity data stored in RAM 203 and the life data stored in ROM 202. When the former becomes larger than the latter, it is judged that the image forming unit 40 has come to the end of its life. If the process unit 40 has not come to the end of its life, the processing reverts to step #9. If it has, the upper 6 digit of the recognition number of the manufacturer's code of the process unit 40 is stored in the memory area of the life end unit number (step #14), and prohibits the copying operation not to accept a new copy start operation (step #15). When the copying operation is prohibited, no copying action is permitted until the time of next power source being turned on.

As mentioned in the above, as regards the present invention, any copying operation can be prohibited by checking the confidential identity number in step #3 against the possible use of imitation products. Although in the case where the content of RAM 203 is copied as it is, the copying operation can not be prohibited by checking in step #3, where RAM 203 of the process unit 40 having come to the end of its life, this fact can be checked in step #6 and the copying operation can be prohibited. Furthermore, in step #6, the process unit 40 of the same recognition member can be used only once in the same main body 1. The use of illegal imitation products made by third parties and consumptive component parts such as regenerated products other than the genuine products can be efficiently prohibited, leading to a quality warrant being surely carried out.

In this embodiment, the description was made of the image forming unit of the coping machine as a comsumptive component part as an example. However, the present invention is not limited to this example. Other consumptive component parts, such as the toner replenishment until are possible to be inserted into or removed from the place at which toner is replenished and for housing toner used for replenishing will do, and as for the image forming apparatus, any one such as a laser printer or liquid crystal printer can be used.

Furthermore, in this embodiment, descriptions were made as to an example wherein, a manufacture's code as a distinguishing information particular to a component part and a confidential identity number showing that the comsumptive component part is genuine were stored in a RAM equipped on a consumptive component part. It is not always necessary to have information showing that a consumptive component part is genuine stored in the memory medium of the consumptive component part, but such information may be stored in the control unit of the main body of an image forming apparatus in which a consumptive component part is set.

In this embodiment, explanation was made about an image forming unit wherein a photosensitive drum, an eraser lamp, a developer unit, a cleaning unit and an corona charger are integrated.

However, it is not always necessary for all of these image forming elements to be integrated. A image forming unit can be used in which a photosensitive drum and a single or plural aforesaid image forming element(s) other than the photosensitive drum are integrated, such as the photosensitive drum and a developer unit, or the photosensitive drum, developer unit and a cleaning unit.

As is described above, according to the present invention, by checking the confidential identity number as the second identifying information and by checking the recognition number as the first distinguishing number, imitation products and regenerated products can be identified, which can lead to prohibiting the use of the illegal consumptive component parts made by outsiders.

As this invention may be embodied in several forms without departing from the spirit of the essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An image forming apparatus comprising, a consumable component part that can be set in and removed from said apparatus;

memory means for storing a first identifying information specifying said consumable component part;

read-out means for reading out said first identifying information from said memory means, when said consumable component part is set in said apparatus;

information processing means for processing said first identifying information in a predetermined method;

a collating means for collating the processing result by said information processing means with a predetermined second identifying information; and control means for controlling a image forming operation in accordance with the collating result of said collating means.

2. An image forming apparatus as set forth in claim 1, wherein said control means executes said image forming operation in the case where said collating result coincides, and prohibits said image forming operation in the case where said collating result fails to coincide.

3. An image forming apparatus as set forth in claim 1, wherein said memory means stores said first and second identifying informations.

4. An image forming apparatus as set forth in claim 1 wherein the first identifying information is a manufacturer's code assigned at the time of manufacture of said consumable component part, and said second identifying information is a code obtained as the result of processing said manufacturer's code in a predetermined operation formula.

5. An image forming apparatus as set forth in claim 1, wherein said consumable component part is a process unit comprising an image holding member rotatable in a predetermined direction, image forming means for acting upon said image holding member, and a housing for supporting said image holding member and image forming means integrally.

6. An image forming apparatus as set forth in claim 3, wherein said first identifying information is a manufacturer's code assigned at the time of manufacture of said consumable component part, and said second identifying information is a code obtained by processing said manufacturer's code in a predetermined operation formula.

7. An image forming apparatus as set forth in claim 5, wherein said image forming means comprises at least one of an apparatus selected from groups of a developing unit which makes developer attach to a latent image held by said image holding member, a cleaning unit to remove the developer remaining in said image holding member, and an charger to charge a surface of said image holding member.

8. An image forming apparatus comprising, a consumable component part that can be set in and removed from said apparatus;

first memory means incorporated in said comsumable component part, for storing a first identifying information specifying said consumable component part;

read-out means for reading out said first identifying information from said first memory means;

information processing means for processing said first identifying information in a predetermined method;

collating means for collating the processing result by said information processing means with a predetermined second identifying information;

life judging means for making judgement of the life of said consumable component part by measuring the used quantity since the start of use of said consumable component part; and control means for controlling a image forming operation in accordance with the collating result made by said collating means and the judging result by said life judgment means.

9. An image forming apparatus as set forth in claim 8, further comprising second memory means for storing said first identifying information on the consumable component part having been judged that its life has come to an end by said life judging means.

10. An image forming apparatus as set forth in claim 8, wherein said control means executes said image forming operation in the case where said collating results coincide, and said judging result shows the consumable component part has not come to the end of its life and prohibits said image forming operation in the case where said collating result fails to coincide or where said life judging means judges that the life has come to the end.

11. An image forming apparatus as set forth in claim 8, wherein said first memory means stores said second identifying information.

12. An image forming apparatus as set forth in claim 8, wherein said first identifying information is a manufactor's code assigned at the time of manufacturing of said consumable component part, and said second identifying information is a code obtained by processing said manufacturer's code in a predetermined operation formula.

13. An image forming apparatus as set forth in claim 8, wherein said consumable component part is a process unit including an image holding member rotatable in a predetermined direction, image forming means for acting upon said image holding member, and a housing for supporting said image holding member and image forming means integrally.

14. An image forming apparatus as set forth in claim 9, wherein said control means prohibits said image forming operations in the case where said collating result fails to coincide or where said first identifying information stored in said first memory means and the first identifying information stored in said second memory means coincide.

15. An image forming apparatus as set forth in claim 11, wherein said first identifying information is a manufacturer's code assigned at the time of manufacture of said consumable component part, and said second identifying information is a code obtained by processing said manufacturer's code in a predetermined operation formula.

16. An image forming apparatus as set forth in claim 13, wherein said image forming means comprises at least one of an apparatus selected from the groups of a developer unit which makes developer attach to a latent image held by said image holding member, a cleaning unit for removing developer remaining in said image holding member and charger for charging said image holding member.

17. A genuine article distinguishing apparatus for recognizing a replaceable article installed at a predetermined position and distinguishing whether said article is genuine or not, comprising, memory means, installed in said article, for storing data of a first identifying information specifying said article;

information recognizing means for recognizing said first identifying information stored in said memory means; and collating means for processing said first identifying information recognized in said information recognizing means in a predetermined method and for collating the processed result with data of a predetermined second identifying information showing that said article is genuine.

18. A genuine article distinguishing apparatus as set forth in claim 17, wherein said first identifying information is stored in said memory means at the time of manufacture of said article.

19. The genuine article distinguishing apparatus as set forth in claim 17, wherein said first identifying information is a manufacturer's code assigned at the time of manufacture of said article, and the second identifying information is a code obtained by processing said manufacture's code in a predetermined operation formula.

20. In an image forming apparatus for providing images on paper by creating images on a photosensitive member, developing the images and transferring the developed images to paper, the improvement comprising:

a consumable component part that is replaceable during the expected life of the image forming apparatus, including a predetermined set of data characteristic of the component part;

means for determining the predetermined set of data from the component part;

means for verifying that the predetermined set of data is valid, including processing the data to determine a specific confidential value and verifying the processed data result;

means for providing an indication of a total life cycle value of the component part;

means for continually providing an actual usage of the component part life cycle as a result of use of the image forming apparatus;

means for storing the actual usage of the component part life cycle means for comparing the total life cycle value with the actual usage of the component part life cycle, and means for preventing the image forming apparatus to operate when one of an invalid data is determined by the verifying means and the actual usage of the component part life cycle matches the total life cycle value.

21. The image forming apparatus of claim 20 further including means for determining if the predetermined set of data characteristic of the component part has previously been used through its total life cycle and prohibiting its subsequent use upon such a determination, thereby prohibiting a regeneration of a used component part.

* * * * *